United States Patent [19]

Brunato

[11] 3,987,910

[45] Oct. 26, 1976

[54] APPARATUS FOR RACKING DRILL PIPES ON FLOATER TYPE PLATFORMS

[76] Inventor: Siro Brunato, Via G. Galli, 23, Melegnano (Milan), Italy

[22] Filed: Feb. 7, 1975

[21] Appl. No.: 548,127

[52] U.S. Cl. ..... 214/2.5; 175/85

[51] Int. Cl.[2] ..... E21B 7/04; E21B 15/00

[58] Field of Search ..... 214/2.5; 175/85; 211/60; 254/137

[56] References Cited

UNITED STATES PATENTS

| | | | |
|---|---|---|---|
| 3,507,405 | 4/1970 | Jones | 214/2.5 |
| 3,539,024 | 11/1970 | Irons | 214/2.5 X |

*Primary Examiner*—Philip Goodman

*Attorney, Agent, or Firm*—Guido Modiano; Albert Josif

[57] ABSTRACT

Racking apparatus and method for accomplishing racking of drilling pipes in a vertical position from the rig floor downward.

A container located in the substructure area of the floating platform provides for the supporting of the pipes; while a triple-acting racking crane provides for the handling and racking operation of the pipes and, two racking frames provide for proper alignment of each stand inside the container.

Auxiliary equipment is also provided for working in connection with the racking apparatus in order to fit all phases throughout the racking operation.

6 Claims, 5 Drawing Figures

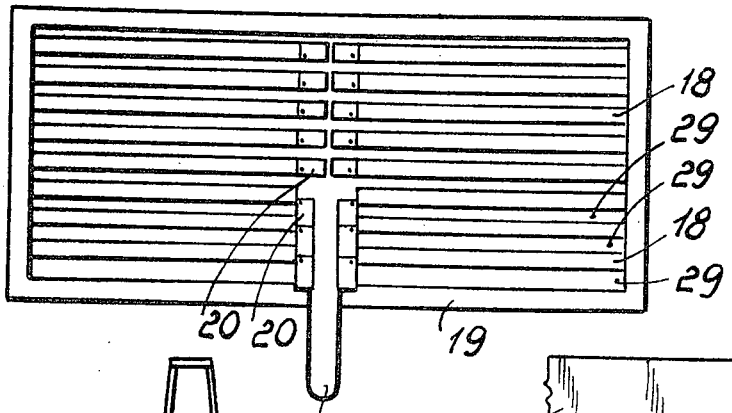
Fig.4
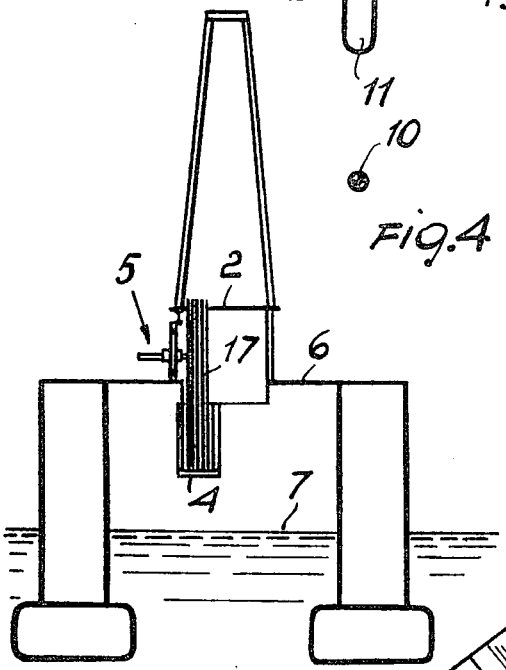
Fig.1
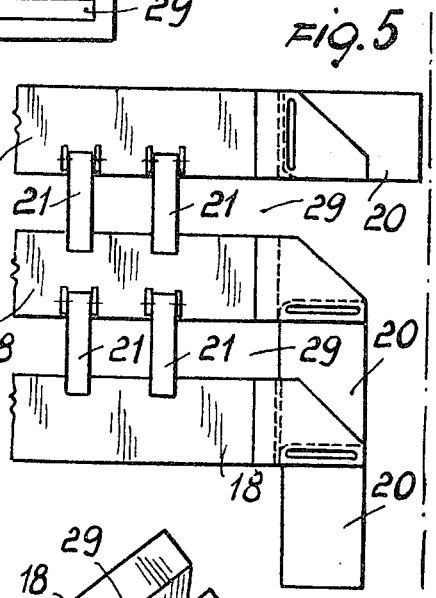
Fig.5
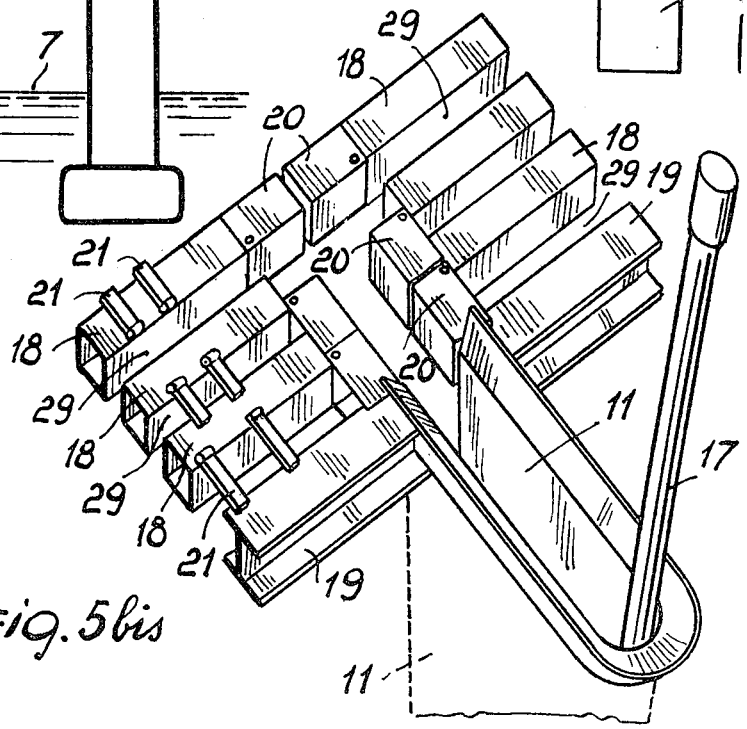
Fig.5bis

APPARATUS FOR RACKING DRILL PIPES ON FLOATER TYPE PLATFORMS

BACKGROUND OF THE INVENTION

This invention relates to a system for racking drill pipes, used in the drilling activity and, more in particular to a method where the drill pipes, in stands averaging usually 90 feet in length, are positioned vertically from the rig floor downward into a container located in the area of the rig substructure and, to the related apparatus necessary to handle the stands of pipes from the centerline of the Rotary Table to the racking area position and, viceversa.

In the drilling of a well, anytime the drilling bit is worn-out, it is necessary to extract from the hole the whole string of drill pipes to replace the worn-out bit and then to lower it back into the same hole to resume drilling operation. In doing this, it is customary, as well known in the drilling art, to break down the drill string into stands, usually 90 feet long.

Today, in all fixed type rigs and also in the largest percentage of the floater type platform, the stands are racked by man power inside the derrick, in vertically standing position from the rig floor upward.

Two types of mechanical racking systems are today available for the floater type platforms:

one type is a system having basically three horizontal arms mounted at different elevations on the front side of the derrick and accomplishing a mechanical handling of the stand from the centerline of the Rotary Table to the setback area position on the rig floor and, viceversa; the other type of system allows for a horizontal racking of the stands on the deck of the ship and out of the derrick configuration, basically accomplished by mechanical handling devices, where the stand is first pulled out of the derrick and than racked horizontally.

In the first system, since the pipes are racked into the derrick, a stronger derrick is required to sustain the dynamic load deriving from the floater motion, and also floater stability may be quite compromised in severe sea conditions.

The second mentioned system is suitable for installation only on drilling ships: the derrick is not subject to dynamic forces and ship stability is improved as a result of the lower center of gravity of the racked pipes, but the bending damage occurring to the stands as a result of the transferring operation from the derrick to the ship deck and, viceversa, is also well recognized.

SUMMARY OF THE INVENTION

This invention encompasses a system for a mechanical handling of the pipe stands and for racking the same in a vertical position from the rig floor elevation downward, where only a few feet of pipe remain above the elevation of the rig floor.

The system of this invention includes:

a. a box type container for the pipes;

the container is of closed type design for application on a drilling ship, and it is clustered in the moon pool area opening and, may project partly below the keel line for assuring best stability conditions;

the container is of structural design and permanently attached to the deck structure for installation on a semi-submersible platform;

structural design is required in such a case to reduce to a minimum the wave impact force in very severe storm conditions; anyhow, a sufficient air gap is left between the sea water level, in order that for medium severe sea conditions the waves' crest will not have a hard impact against the bottom of the container.

b. two racking frames, having in the middle portion special designed gates forming a guide for the pipe stand to the selected slot; the two frames, similar in dimensions and configuration, are vertically aligned and, one is installed on the rig floor, the other is installed on the top of the container;

c. a guiding trough, vertically positioned and linking the rig floor elevation down to the top of container, its purpose being to guide the pipe stand being lowered from the rig floor into the container, or viceversa when the stand is retrieved from the same container;

d. a triple-acting racking crane, basically formed of a handler arm that extends and retracts while moving vertically and laterally with a carriage assembly to give full coverage over the racking area; the racking crane is enclosed in a tracking frame vertically positioned on one side of the rig substructure;

e. a hydraulic power unit to operate the racking crane of point (d) and in addition the stabber and lifting cylinder of points (f) and (g);

f. a stabber, basically an extendable and retractable arm mounted at a convenient elevation above the rig floor and, having the function of moving the pipe stand from the centerline of the Rotary Table to above the trough opening and viceversa, and, also to be used as a tilting device for the drill pipes elevator;

g. an assembly, including a double-stroke hydraulic cylinder in conjunction with a "jolly elevator" for racking the heavy drill collar stands. The assembly can also be used as emergency equipment for racking the same pipe stands.

It is an object of this invention to provide for a new racking method and relative handling apparatus, enabling to cut down and alleviate the manual work required for tripping of the drill pipes on a floater platform, to increase safety for the people, to reduce the number of people required for the specific tripping operation and to cut down tripping time.

It is also an object of this invention to provide for a standard racking system suitable for installation on any type of floater, even semi-submersible or drilling ships.

It is also an objective of the invention to provide for the racking of the drill pipes at the lowest practical position on a floater in order to improve stability of the same floater.

It is a further object of this invention to provide for a vertical racking of the pipes occupying only the well known set back area on the rig floor, in order to clear completely the deck on a drilling ship and use it conveniently as material storage area.

In addition, it is a further object of this invention to provide a drilling ship with an effective stabilizer fin, obtained by the portion of the container projecting below the keel line of the ship.

It is also an object of this invention to provide a new and simple racking apparatus, consisting of a triple-acting racking crane and two specially designed racking frames, in addition to a set of accessories needed for handling efficiently the pipe stands throughout all phases of the racking operation.

It is a further object of this invention to provide for a racking system adapted for the best use of the "Electric Power Swivel".

Other objects, features and advantages of the invention will be apparent from the specification, the drawings and the claims.

BRIEF DESCRIPTION OF THE DRAWINGS

FIG. 1, is a schematic vertical cross-sectional view of the apparatus according to the invention, mounted on a semi-submersible platform;

FIG. 4 is a plan view of a detail of the apparatus according to the invention; and FIG. 5 is a partial plan view of a detail of FIG. 4;

FIG. 5 bis is a perspective view of FIG. 4.

DESCRIPTION OF A PREFERRED EMBODIMENT

Figure 2:
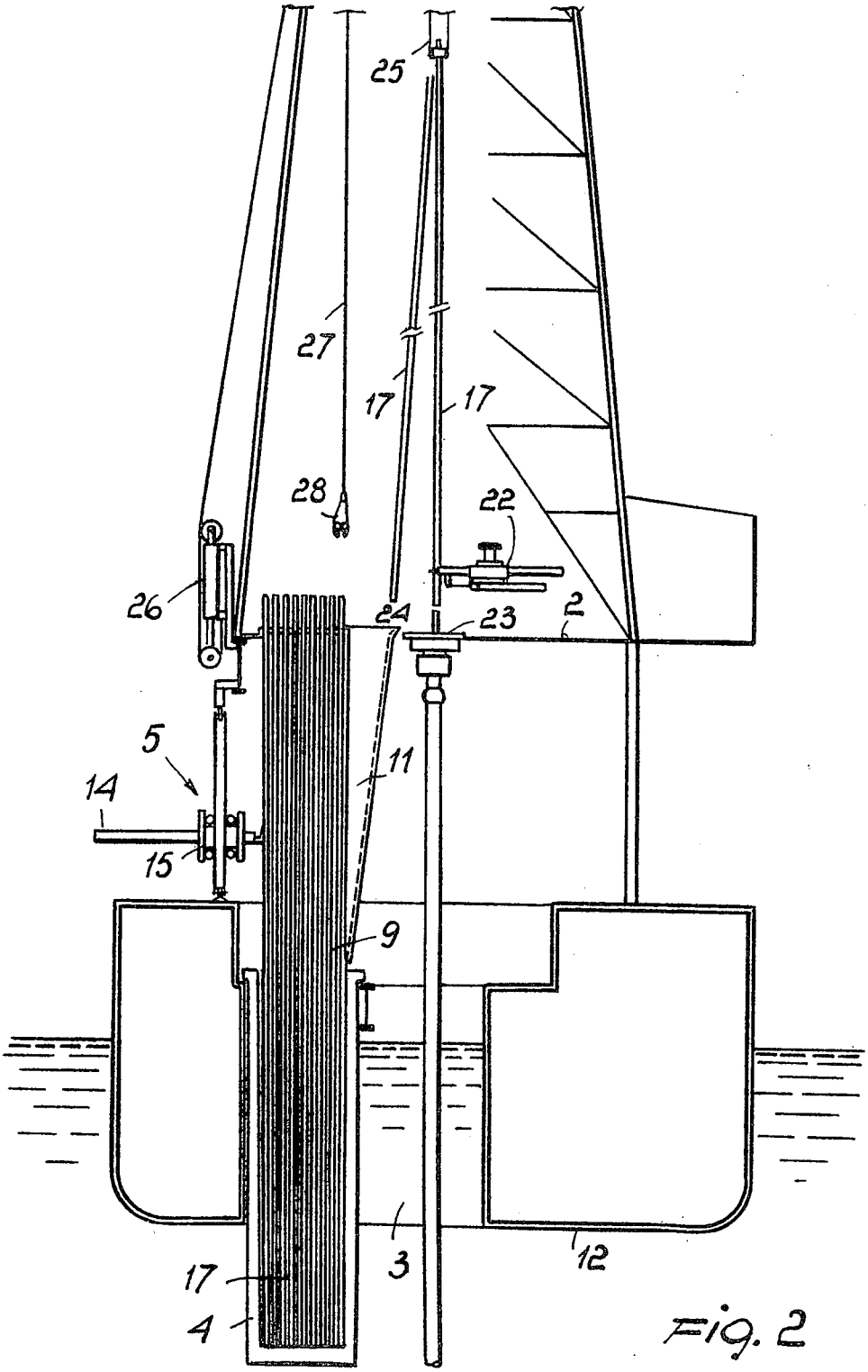
FIG. 2 is a detailed vertical cross-sectional view of the apparatus according to the invention, mounted on a drilling ship.

With reference to the drawings, FIG. 2 shows the box type container 4 clustered into the moon pool area of the ship structure 1.

The container 4 projects for some extension below the keep line 13, thus exposing a large surface area which acts as an effective rolling stabilizer fin.

The container 4 can move vertically inside the opening, and so far retracted inside the keel line 13 as to assure best seagoing conditions to the ship.

The container 4 can be retrieved up by buoyancy, or by a travelling block (not shown) using four slings attached to each corner on top of the container 4, or by four hydraulic jacks (also not shown) suspended underneath the rig floor 2 and attached to each corner on top of the container 4.

Furthermore, referring to FIG. 2, the container results filled up with fresh water, assuring, during the racking operation, a stabilizing effect to the bottom portion of the pipe and a non corrosive environment for the same pipes.

The container is also provided with a water jetting system (not shown) to remove sediments accumulated on the bottom, a dampening valve and an eductor to remove the water from the inside.

The bottom of the container might also be provided with several openings, thus eliminating the need of the above mentioned specific requirements.

Embodiments of these features are not shown for simplicity and also because different solutions may be adopted for each single installation.

For instance in a ship designed with a very high rig floor 2, referring to FIG. 2, the bottom of the container 4 can correspond to the keel line of ship, thus eliminating the need of a clustered container, which in such a case can be obtained within the ship bulkhead.

The container 4 required for application on a semisubmersible platform, FIG. 1, has a pipe frame supporting a bottom structure on which the pipes are borne. The container 4 is permanently welded to the deck structure 6 of the platform and properly trussed to assure its best strength.

A structural container is required for a semisubmersible platform for minimizing the wave force impact on the container 4 in very severe sea conditions.

Anyhow, a sufficient air gap is conveniently left between the sea water level to guarantee that in medium severe sea conditions the wave crests will not strike against the bottom surface of the container 4.

Semisubmersible platforms are so varied in size, shape and structure that it is impossible to embody an actual form for the container 4.

Figure 3:
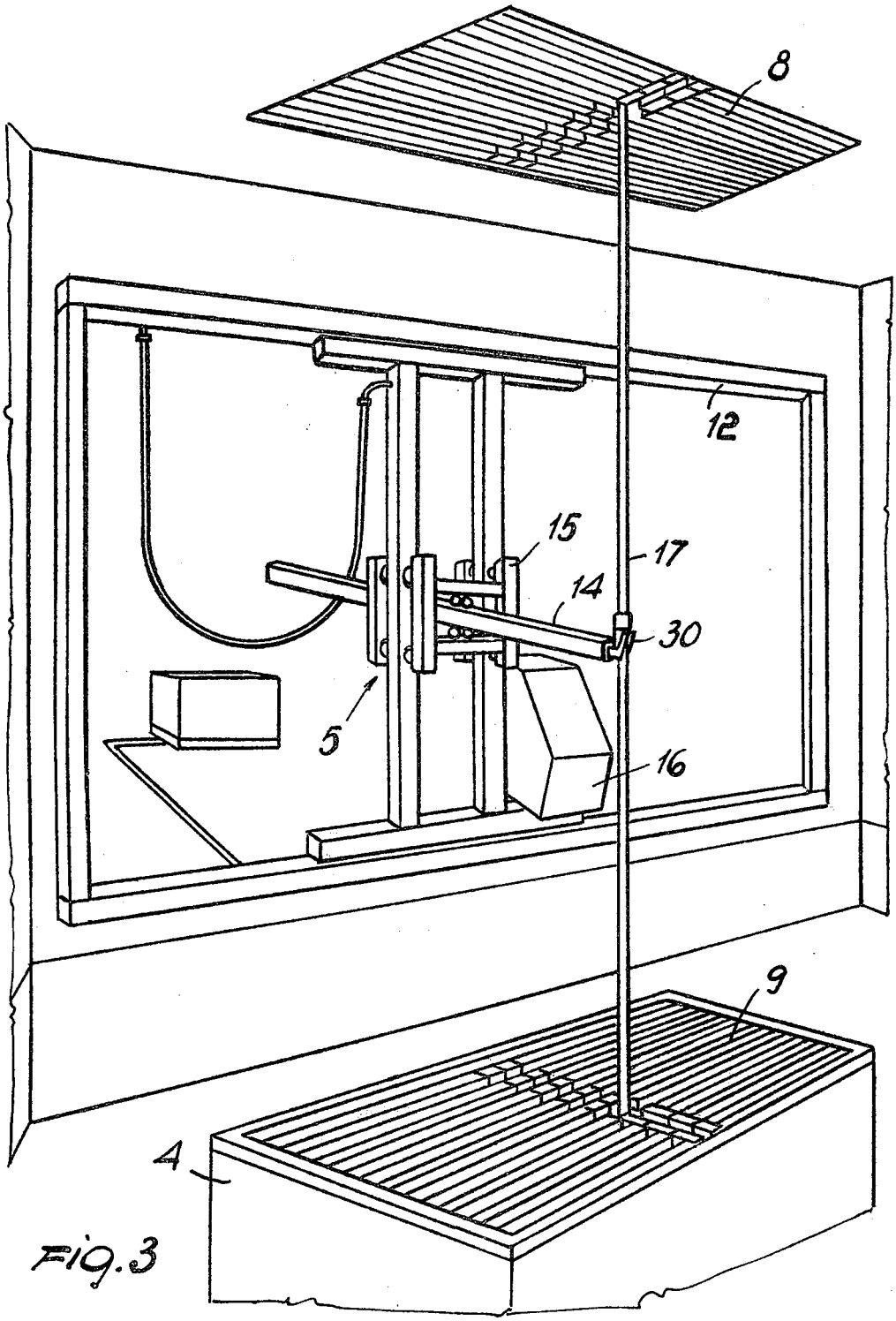
FIG. 3 is a perspective view of a detail of the apparatus according to the invention.

The triple-acting racking crane 5 shown positioned on the side of the rig substructure in FIG. 2, is better detailed in FIG. 3.

The racking crane 5 enclosed in a tracking frame 12 has an handler arm 14 that extends and retracts while moving vertically and laterally with a carriage assembly 15. The racking crane 5 is provided with a cabin 16 for the operator, which encloses all necessary control devices to perform the three mentioned movements.

The racking crane 5 can be conveniently powered by hydraulic means for meeting the safety regulations in the specific field.

Always referring to FIG. 3, the arm 14 has a finger type lifting head 30 that hooks the first tool joint from the top of the stand 17.

The stand 17 can then be lifted and moved along two horizontal axes and properly guided by the selected slots of the upper frame 8 and lower frame 9.

The typical construction of the racking frame 8 or 9 shown in a plan view in FIG. 4 and partially detailed in FIG. 5 has fixed type fingers 18 welded on one side to a rectangular frame 19 while the free ends have pivoted thereto turning gates 20, openable by 90°.

The gates 20 can be manually operated or air operated in opening and closing by the use of an air cylinder mounted underneath each square pipe finger 18, allowing in such a case for remote control from a console.

The FIGS. 4 and 5 show some of the gates 20 selected in an open position, while the remaining are in a closed position.

The gates selection made on both frames establishes two similar guides for the pipe stand 17, thus that the same stand hooked by the handler arm 14 will follow positively controlled into the selected racking slots.

The fingers 18 are properly spaced to allow passage to the most commonly used 5 inch diameter drill pipes, while two slots on each racking frame 8 and 9 are wider for racking the larger diameter drill collars.

Typical stoppers 21 shown in FIG. 5 are provided for each frame in order to keep each stand 17 individually in position.

FIG. 2 shows the profile of the trough 11 linking the rig floor 2 down to the lower racking frame 9, while FIGS. 4 and 5 bis show in detail the trough opening on the rig floor 2 aligned between the centerline 10 of Rotary Table and the opening formed by the gates 20 when opened.

Also, FIG. 2 shows the stabber 22 mounted at some elevation above the rig floor 2.

The stabber 22 is basically an extendable and retractable arm, hydraulically operated, having the function, as shown in FIG. 2, of displacing the bottom of the stand from the centerline position 23 to position 24 over the trough opening, or viceversa.

The stabber 22 also performs the function of keeping in alignment the stand 17 during tool joint connection and it is also used to tilt the pipe elevator 25 between the mentioned positions 23 and 24.

FIG. 2 also shows the assembly formed from the doubled stroke hydraulic piston 26 mounted on the side of rig floor, the wire cable 27 linked to the jolly elevator 28. Said assembly is used to handle the heavy drill collar stands and to rack them into slots 29 of the racking frame shown in FIGS. 4 and 5.

The handler arm 14 is used in this operation for assisting lateral displacement of the drill collar stands.

The embodiments of this invention illustrated with the accompanying drawings will appear more clearly by the following operational description.

a. Pulling Drill Pipes Out the Hole

A pipe stand usually 90 feet in length is pulled out from the Rotary Table; the stabber 22 is engaged around the pipe and tool joint connection is broken off.

Eventually the stabber 22 moves the bottom of the stand from position 23 to 24 above the trough opening 11.

The stand 17 is lowered by the elevator 25 into the trough 11 until it touches the bottom of the container 4. A rubber cushion is placed in the central part of the supporting bottom to soften the impact of the stand.

The elevator 25 is then released from the stand and engaged again around the drill string for pulling out a new stand.

Meanwhile, the operator extends the handler arm 14 forwards to hook up the pipe stand lying inside the trough 11; he raises the carriage 15; he retracts the arm 14 until the stand 17 — referring to FIGS. 3 and 4 — stops against the gates 20 in closed position on upper frame 8 and lower frame 9; then he moves the crane laterally to reach the last position of the selected slot 29, and he lowers the arm 14 to leave the stand in place, while a man on the rig floor 2 secures the stand in place by flipping down the stopper 21.

b. Running Drill Pipes into the Hole

The operator moves the handler arm 14 and picks up the stand from the racking position.

He moves the stand 17 laterally towards the centerline 10 of the racking frames 8 and 9 and then forwards by extending the arm 14.

He lowers the carriage 15 and leaves the stand inside the trough 11.

The elevator 25, released from the string above the Rotary Table, is tilted by the stabber 22 and engages the stand lying inside the trough 11.

The stand is then raised out of the trough by the elevator 25 and retrieved from position 24 to 23 by the stabber 22 and kept in line with the centerline 10 of the Rotary Table until tool joint connection is made-up and, following it the stabber 22 is retracted again by a certain extent in order to clear passage for the lowering string.

It is to be understood that the foregoing disclosure and description of the invention is not to be limited to specific forms and arrangements or parts herein described as shown.

Changes in the size, shape and materials, as well as in the details of the illustrated equipment, may be made in accordance to practical installation requirements and within the scope of the appended claims, without departing from the spirit of the invention.

I claim:

1. In an apparatus for temporary vertical racking below the drilling floor of drill pipes in stands on floater type drilling platforms, the combination comprising:

a container installed in a rig substructure area comprised inside a derrick plan configuration and projecting vertically downward to receive and support drill stands;

two racking frames similar in size and configuration, an upper one installed on the rig floor and a lower one parallel thereto on the top of said underlying container and said two racking frames being vertically aligned with each other in order to rack the pipe stands into vertical position;

a racking crane positioned in between said two racking frames and having three orthogonal movements wherein, a handler arm with a lifting head extends and retracts while moving vertically and laterally with a carriage assembly to give full coverage over the racking area;

a trough connecting the rig floor to said lower racking frame and acting as a guide for the pipe stand being lowered into the container or viceversa being retrieved from it;

a pipe stabber mounted above the rig floor for handling and moving the bottom of the pipe stand in alignment with centerline of a Rotary Table and a trough opening;

a lifting assembly for handling the heavier drill collar stands, wherein each of said racking frames have two sets of fixed type fingers properly spaced, and a set of 90° turning gates used to establish a guide for the pipes.

2. In a system for the racking of drill pipes, as claimed in claim 1, wherein the guiding trough has an adequate shaped profile and opening to allow the insertion of said handler arm of said racking crane in order to hoist the pipe under the first tool joint by means of a lifting head.

3. In a system for the racking of drill pipes, as claimed in claim 1, wherein said pipe stabber is an extendable and retractable arm moved by a hydraulic cylinder and pivoted for 90° degree rotations by means of a hydraulic piston, and carrying a standard type clamp.

4. In a system for the racking of drill pipes, as claimed in claim 1, wherein the assembly for handling the drill collars consists of a double-stroke hydraulic cylinder, acting on a wire rope idled to a sheave positioned at the top of the derrick and a jolly elevator connected to the free end of said wire rope.

5. In an apparatus for temporary vertical racking below the drilling floor of drill pipes in stands on floater type drilling platforms, the combination comprising:

a container installed in a rig substructure area comprised inside a derrick plan configuration and projecting vertically downward to receive and support drill stands;

two racking frames similar in size and configuration, an upper one installed on the rig floor and a lower one parallel thereto on the top of said underlying container and said two racking frames being vertically aligned with each other in order to rack the pipe stands into vertical position;

a racking crane positioned in between said two racking frames and having three orthogonal movements wherein, a handler arm with a lifting head extends and retracts while moving vertically and laterally with a carriage assembly to give full coverage over the racking area;

a trough connecting the rig floor to said lower racking frame and acting as a guide for the pipe stand being lowered into the container or viceversa being retrieved from it;

a pipe stabber mounted above the rig floor for handling and moving the bottom of the pipe stand in alignment with centerline of a Rotary Table and a trough opening;

a lifting assembly for handling the heavier drill collar stands.

6. An apparatus, as claimed in claim 5, further comprising a tracking frame enclosing said racking crane and positioned on a side of said substructure in between said two racking frames and having hydraulic and mechanical means to perform said three orthogonal movements, including a cabin for housing the operator and control devices and safety means.

* * * * *